US006119766A

United States Patent [19]

Blomgren

[11] Patent Number: 6,119,766

[45] Date of Patent: Sep. 19, 2000

[54] PLATE HEAT EXCHANGER WITH CONNECTION PIPES LINED WITH BELLOWS

[75] Inventor: Ralf Blomgren, Skanör, Sweden

[73] Assignee: Alfa Laval AB, Lund, Sweden

[21] Appl. No.: 09/202,110

[22] PCT Filed: Jun. 23, 1997

[86] PCT No.: PCT/SE97/01119

§ 371 Date: Dec. 18, 1998

§ 102(e) Date: Dec. 18, 1998

[87] PCT Pub. No.: WO98/00679

PCT Pub. Date: Jan. 8, 1998

[30] Foreign Application Priority Data

Jun. 28, 1996 [SE] Sweden ..... 9602571

[51] Int. Cl.[7] ..... E28F 7/00

[52] U.S. Cl. ..... 165/81; 165/167; 165/DIG. 359

[58] Field of Search ..... 165/81, 167, DIG. 359; 138/14, 178

[56] References Cited

U.S. PATENT DOCUMENTS

| | | | |
|---|---|---|---|
| 1,770,980 | 7/1930 | Gould . | |
| 3,916,871 | 11/1975 | Estes et al. | 165/81 |
| 3,934,618 | 1/1976 | Henderson | 165/81 |
| 3,992,169 | 11/1976 | Loudon | 165/81 |
| 3,999,403 | 12/1976 | Bower et al. | 165/81 |
| 4,140,172 | 2/1979 | Corey | 165/81 |

FOREIGN PATENT DOCUMENTS

| | | | |
|---|---|---|---|
| 570579 | 12/1975 | Switzerland | F22B 1/02 |
| WO 95/31687 | 11/1995 | WIPO | F28F 9/02 |

*Primary Examiner*—Ira S. Lazarus
*Assistant Examiner*—Terrell McKinnon
*Attorney, Agent, or Firm*—Fish & Richardson P.C.

[57] ABSTRACT

In a plate heat exchanger (1) comprising a package (3) of heat transfer plates (2) arranged between two frame plates at least one of the frame plates (6) is provided with connection pipes (9) for one or two heat exchange fluids. The connection pipes (9) are provided with internal linings (10), which are permanently connected round the ports (4) to an outer heat transfer plate (14) of the package (3) of heat transfer plates (2). Each lining (10) is arranged with room (12) for radial movement inside its connection pipe (9) and provided with at least one bellows (11) adapted—upon relative displacement between the one frame plate (6) and the outer heat transfer plate (14) in a direction across the connection pipe (9)—to facilitate bending of the lining (10). Thereby, a very compact plate heat exchanger (1) can be obtained.

11 Claims, 2 Drawing Sheets

PLATE HEAT EXCHANGER WITH CONNECTION PIPES LINED WITH BELLOWS

FIELD OF THE INVENTION

The present invention concerns a plate heat exchanger comprising two relatively thick frame plates between which a package of permanently joined, relatively thin heat transfer plates is arranged. The heat transfer plates may be joined e. g. by welding, brazing or gluing. The heat transfer plates are provided with inlet and outlet ports, which form channels through the package for at least one heat exchange fluid. These channels communicate with flow passages, which are formed in the interspaces between the heat exchange plates. At least one of the frame plates is provided with through holes, which communicate with said channels and with the interior of connection pipes firmly connected with the frame plate. The flow passages between the heat transfer plates, the channels through the plate package, the through holes in the frame plate and the interior of the connection pipes form the system of flow paths making the flow of heat exchange fluid through the plate heat exchanger possible.

BACKGROUND OF THE INVENTION

In plate heat exchangers of the kind described above the heat transfer plates are often made of stainless steel, whereas the frame plates and the connection pipes for cost reasons are made of steel which is not stainless. For protection of a frame plate provided with holes and also connection pipes connected therewith from contact with a heat exchange fluid linings, which are preferably made of the same material as the heat transfer plates, are often arranged in the through holes of the frame plate and in the connection pipes. The linings have permanent connections with the outer heat transfer plate situated closest to the frame plate, around inlet and outlet ports thereof.

The above described lining arrangement in a plate heat exchanger leads to certain strength problems. The heat transfer plates and the linings are thin and intended to get into direct contact with the heat exchange fluids, which leads to the consequence that these parts of the plate heat exchanger will quickly adopt the temperature of the heat exchange fluids and, thereby, undergo quick changes in length. The frame plates, on the other hand, are considerably thicker than the heat transfer plates and the linings and do not get into direct contact with the heat exchange fluids. Thus, a frame plate with one of its sides is in contact with an outer heat transfer plate in said plate package and with its other side is in contact with ambient air. This makes the frame plates undergo a smaller and, above all, slower change in length than the heat transfer plates.

The different changes in length of the heat transfer plates and the frame plates make the linings, their connections with an outer heat transfer plate and the portions of the outer heat transfer plate, which surround the ports, to be subjected to large forces which can lead to material breakage with subsequent leakage in the heat exchanger. The forces will be extremely large if the heat transfer plates and the linings are made of austenitic stainless steel, which has a particularly large coefficient of linear expansion compared to steel which is not stainless and from which the frame plates are normally made.

One solution to the above described problem with material breakage in or at the linings in a plate heat exchanger of the above described kind is presented in WO 95/31687 A1. This known plate heat exchanger has connection pipes 10, which on their insides are provided with linings 11. The linings 11, which have permanent connections with the heat transfer plate 3 situated closest to a frame plate 6, are arranged in the connection pipes 10 with a gap between a respective lining 11 and a connection pipe. The connection pipes 10 and the linings 11 preferably have a length which is at least twice the diameter of the connection pipes. The length of the linings and said gaps give the linings a possibility of radial movement in their respective connection pipes. Thereby, the forces acting on the linings, on said permanent connections and on the outer heat transfer plate are reduced.

A general advantage of plate heat exchangers is their compact construction. However, the plate heat exchanger described in the above mentioned WO 95/31687 A1 has a drawback in this respect. Thus, according to WO 95/31687, the length of said connection pipes should be relatively large , e. g. twice the diameter of the connection pipes, for the linings to be able to move radially to a desired extent. In practice, even longer connection pipes are used; for instance a plate heat exchanger having heat transfer plates measuring 1750×750 mm and port holes with a diameter of 200 mm may be provided with connection pipes having a length of 800 mm. These rather long connection pipes make the plate heat exchanger less compact than normally desired. Moreover, it has proved that material failure sometimes come up also in plate heat exchangers designed in this way, in most cases round the ports of the outer heat transfer plate.

SUMMARY OF THE INVENTION

The object of the present invention is to provide a plate heat exchanger having linings in the connection pipes and being more compact than the plate heat exchanger known previously through WO 95/31687 A1. The basis for the invention is a plate heat exchanger of the initially defined kind, in which each lining has a permanent connection with an outer heat transfer plate and is arranged with room for radial movement within its connection pipe and within the through hole of the frame plate. The invention is primarily characterized in that each lining is provided with at least one bellows adapted—upon relative displacement between said one frame plate and said outer heat transfer plate in a direction across the connection pipe—to facilitate bending of the lining. Thereby, the stresses acting on the lining, on the permanent connection and on the outer heat transfer plate in its portion closest to the connection are reduced.

By the invention each connection pipe may be made very short, consideration having to be made only to the circumstance that said bellows must have sufficient axial length to allow a desired radial movement of the lining without it being subjected to unacceptably large forces. Thereby, a plate heat exchanger according to the invention can be made more compact than a plate heat exchanger according to the WO-document mentioned above. Thus, a plate heat exchanger of a size as exemplified above may be provided with connection pipes being about half a meter shorter than earlier.

In plate heat exchangers according to said WO-document material breakage has sometimes occurred when the plate heat exchangers have been used in applications where the flow of at least one of the heat exchange fluids is intermittent. Such a flow results in temperature changes which lead to varying loads on the linings, their said permanent connections and the portions round the ports of the outer heat transfer plate. Such varying loads may give rise to fatigue and fatigue breakdown. A plate heat exchanger, in which the linings have been provided with bellows according to the present invention, can be exposed to temperature changes tenfold those to which a plate heat exchanger having linings without bellows can be exposed. This gives most likely a margin for the number of temperature changes before a fatigue breakdown happens, which margin is so large that material breakage in plate heat exchangers according to the invention can be avoided completely.

If a plate heat exchanger having linings provided with bellows according to the invention is used in applications, in which it is not subjected to frequent temperature changes, the temperature interval, within which the plate heat exchanger can be used, can be made larger than for a plate heat exchanger having linings which are not provided with bellows.

According to a preferred embodiment of the invention the lining has two bellows, one at each end of the lining, a piece of bellows-free lining being located between the bellows. A plate heat exchanger provided with linings according to this embodiment, even though the linings have two bellows, can be made more compact than a plate heat exchanger having linings without any bellows. An arrangement of two bellows makes each one of the bellows being exposed to less bending than a sole bellows and, accordingly, the risk of fatigue breakdown is even smaller.

BRIEF DESCRIPTION OF THE DRAWINGS

The invention will be described more closely in the following with references to the accompanying drawings, which in FIG. 1 and FIG. 2 show two embodiments of the invention.

DETAILED DESCRIPTION

Figure 1:
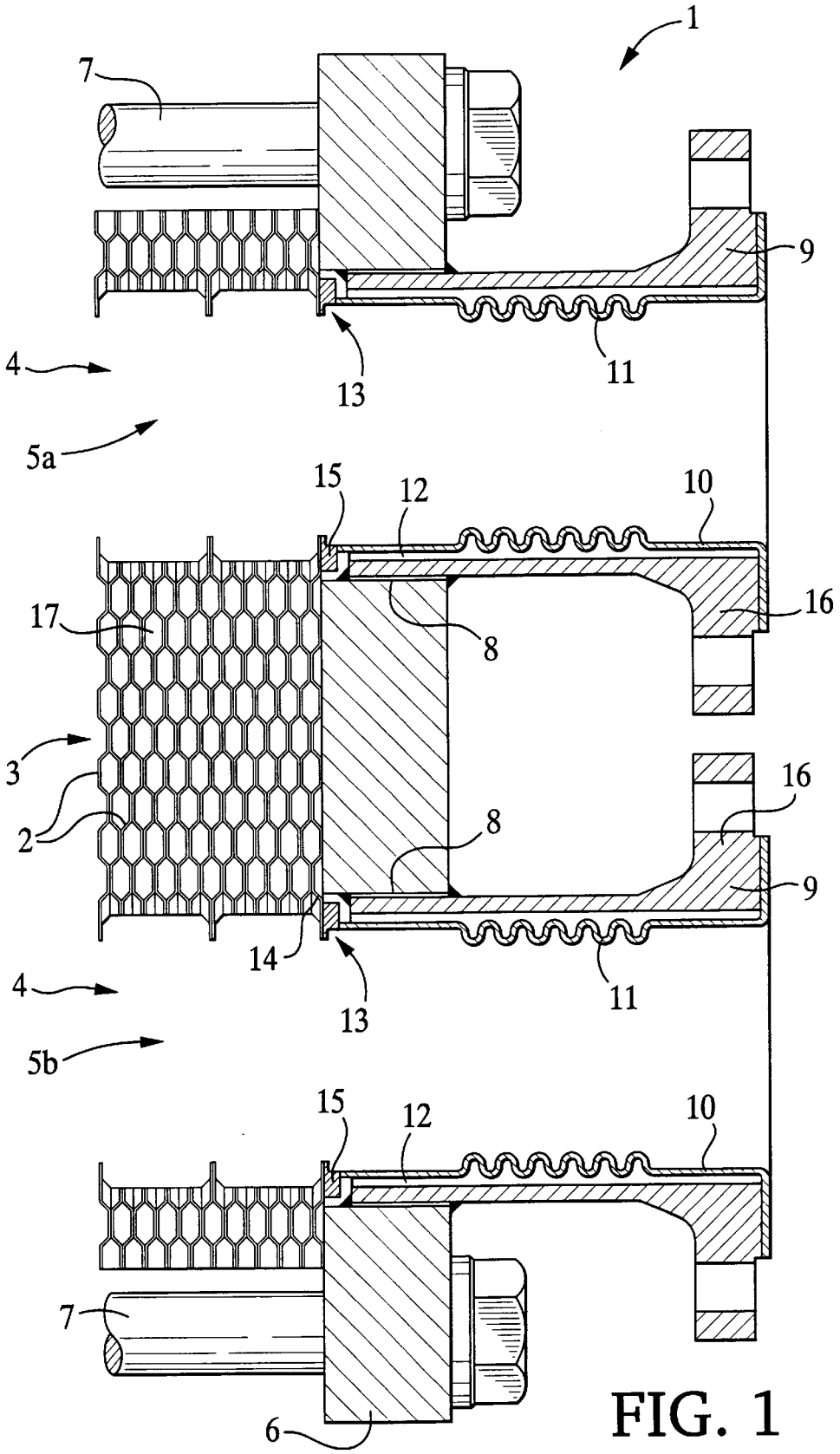

FIG. 1 shows a section through a part of a permanently joined plate heat exchanger 1 according to a first embodiment of the invention. A number of rectangular heat transfer plates 2 are permanently joined with each other, for example through welding, forming a plate package 3. Each heat transfer plate 2 is provided with four ports 4, one in each corner of the heat transfer plate 2. The ports 4 of the heat transfer plates 2 form four channels for two heat exchange fluids through the plate package 3. In FIG. 1 only two channels 5*a*, 5*b* are shown, forming an inlet for one of the heat exchange fluids and an outlet for the other heat exchange fluid, respectively. The plate package 3 is mounted between two frame plates, of which only one frame plate 6 is shown in FIG. 1. The two frame plates are held together by a number of bolts 7.

The frame plate 6 is provided with through holes 8 aligned with respective channels 5*a*, 5*b*. At the through holes 8 connection pipes 9 are firmly connected to the frame plate 6. By means of the connection pipes 9 the plate heat exchanger 1 can be connected to conduits, through which the two heat exchange fluids shall flow to and from the plate heat exchanger 1, respectively. The connection pipes 9 on their insides are provided with linings 10, and each lining 10 is provided with a bellows 11. Between each connection pipe 9 and its lining 10 there is a gap 12. Each lining 10 at one of its ends, by means of a connection 13, is permanently connected to an outer heat transfer plate 14 around one of its ports 4. An intermediate ring 15 can be a part of the connection 13 to facilitate the joining of the lining 10 with the outer heat transfer plate 14. At its other end the lining 10 is formed so that it can be clamped between a flange 16 on the connection pipe 9 and a flange (not shown) on one of the above mentioned conduits. In FIG. 1 only two out of four connection pipes and linings are shown.

Between the heat transfer plates 2 flow passages 17 are formed for the two heat exchange fluids. Every second such flow passage communicates with the inlet channel 5*a* for one fluid but is closed from communication with the outlet channel 5*b* for the other fluid. These flow passages also communicate with an outlet channel (not shown) similar to the inlet channel 5*a*. The remaining flow passages are closed from communication with the inlet channel 5*a* but communicate with an inlet channel (not shown) for the other fluid and with the outlet channel 5*b*.

When the plate heat exchanger 1 is in operation, a temperature difference often arises between the plate package 3 and the frame plate 6, causing that the plate package 3 and the frame plate 6 undergo different changes in length. If, for example, the outer heat transfer plate 14 is subjected to an extension larger than that of the frame plate 6, the permanent connection 13 of the linings 10 will be displaced relative to the connection pipe 9. The connection 13 and the lining 10 then are radially displaced inside one end portion of the connection pipe 9, since the gap 12 permits this. At the other end portion of the connection pipe 9, i. e. in the area of the flange 16, the lining 10 remains substantially immovable relative to the connection pipe 9.

Upon radial displacement of one end of the lining 10, the lining 10 will be bent and, thus, some portions of the lining 10 will be extended and others shortened. The bellows 11 is adapted to absorb these extensions and shortenings and, thereby, reduce stresses acting on the lining 10, the permanent connection 13 and the outer heat transfer plate 14 in its portion closest to the connection 13.

Figure 2:
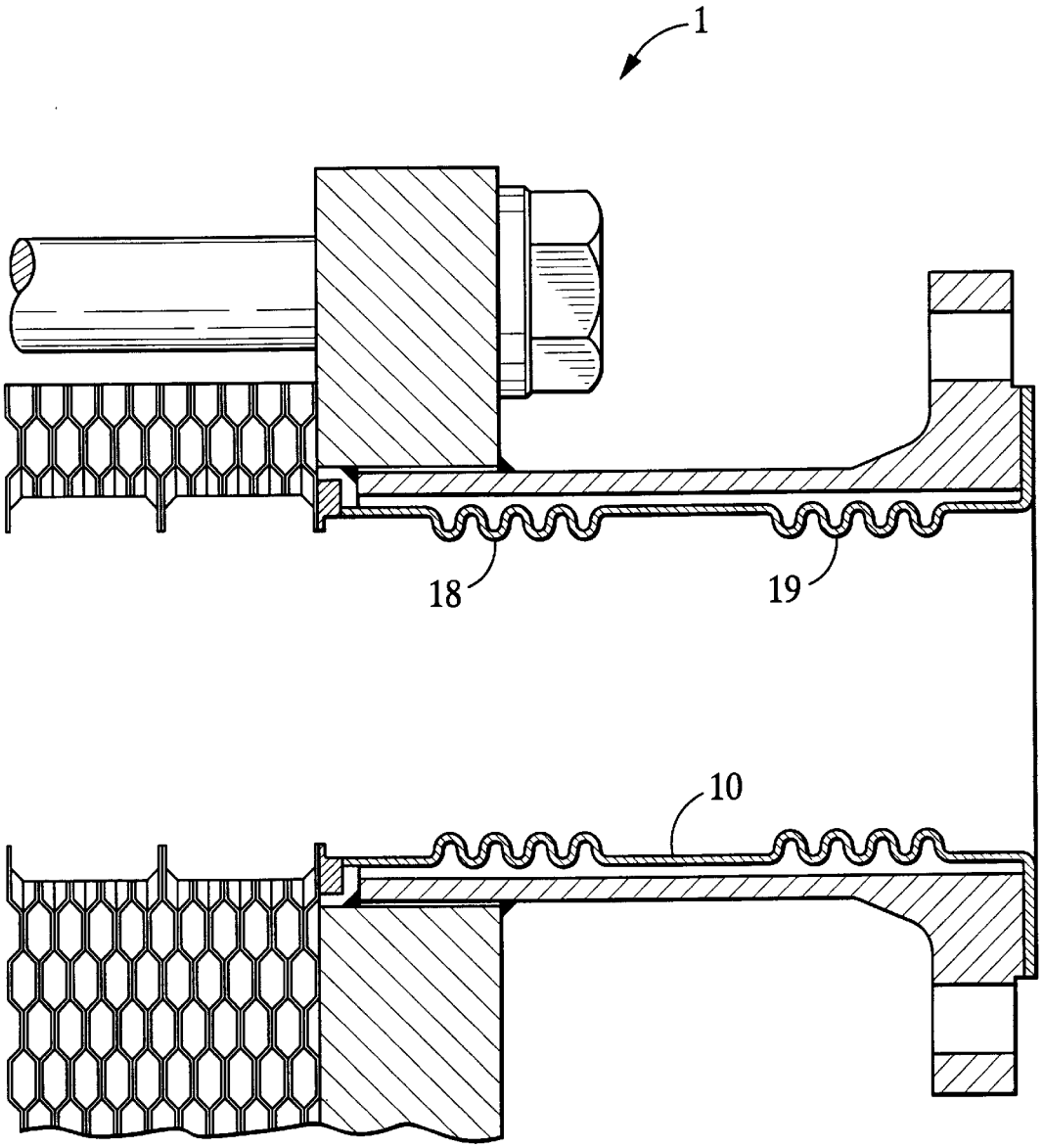

A preferred second embodiment of a lining intended for a plate heat exchanger according to the invention is shown in FIG. 2. For similar details in FIG. 1 and FIG. 2 the same reference numbers have been used.

The plate heat exchanger 1 in FIG. 2 is of the same kind as the one described above but differs in respect of the design of the lining 10. As can be seen, each lining 10 is provided with two bellows 18, 19; one bellows at each end of the lining 10. Each separate bellows 18, 19 will be subjected to less bending than the single bellows 11 in the embodiment according to FIG. 1.

Each one of the bellows 11 and 18, 19, respectively, should have a sufficient number of folds to fulfil its purpose. In a lining provided with only one bellows 10–12 folds can be adequate for the bellows. In a lining provided with two bellows each bellows preferably has 5 folds.

The folds of the bellows are preferably not sharp but rounded, e. g. shaped as adjoining semi circles.

A bellows of the above described kind, particularly in a lining provided with only one bellows, advantageously may be formed as a multilayered bellows, i. e. the bellows may comprise several thin sheet metal layers.

What is claimed is:

1. A plate heat exchanger (1) comprising:

a package (3) of heat transfer plates (2) provided with inlet and outlet ports (4), said ports forming channels through the package (3) for at least one heat exchange fluid, two frame plates (6) between which said package (3) of heat transfer plates (2) is mounted such that an outer heat transfer plate (14) of the package (3) is situated adjacent to one of the frame plates (6), at least said one frame plate (6) having at least one through hole (8), which communicates with one of said channels, at least one connection pipe (9) firmly connected with said one frame plate (6) around its through hole (8), and at least one tubular lining (10), which by means of a permanent connection (13) is connected to said outer heat transfer plate (14) around one of said ports (4) and which extends through said through hole (8) and said connection pipe (9), the lining (10) being arranged with room (12) for radial movement in the connection pipe (9), wherein said lining (10) is provided with at least one bellows (11) having folds adapted—upon relative displacement between said one frame plate (6) and said outer heat transfer plate (14) in a direction across the connection pipe (9)—to facilitate bending of the lining.

2. The plate heat exchanger (1) according to claim 1, wherein said lining (10) is provided with two bellows (18, 19) arranged one at each end of the lining (10) and with a piece of bellows-free lining located between the bellows (18, 19).

3. The plate heat exchanger (1) according to claim 1, wherein said permanent connection (13) between said lining (10) and said outer heat transfer plate (14) comprises an intermediate ring (15).

4. The plate heat exchanger (1) according to claim 1, wherein the folds of said bellows (11 or 18, 19) are rounded.

5. The plate heat exchanger (1) according to claim 1, wherein each bellows (11, 18, 19) is a multilayered bellows comprising several thin sheet metal layers.

6. The plate heat exchanger (1) according to claim 2, wherein said permanent connection (13) between said lining (10) and said outer heat transfer plate (14) comprises an intermediate ring (15).

7. The plate heat exchanger (1) according to claim 2, wherein the folds of said bellows (11 or 18, 19) are rounded.

8. The plate heat exchanger (1) according to claim 3, wherein the folds of said bellows (11 or 18, 19) are rounded.

9. The plate heat exchanger (1) according to claim 2, wherein each bellows (11, 18, 19) is a multilayered bellows comprising several thin sheet metal layers.

10. The plate heat exchanger according to claim 3, wherein each bellows (11, 18, 19) is a multilayered bellows comprising several thin sheet metal layers.

11. The plate heat exchanger according to claim 4, wherein each bellows (11, 18, 19) is a multilayered bellows comprising several thin sheet metal layers.

* * * * *

UNITED STATES PATENT AND TRADEMARK OFFICE

CERTIFICATE OF CORRECTION

PATENT NO. : 6,119,766
DATED : September 19, 2000
INVENTOR(S) : Ralf Blomgren

It is certified that error appears in the above-identified patent and that said Letters Patent is hereby corrected as shown below:

Column 2,
Line 26, change "failure" to -- failures --.
Line 28, change "round" to -- around --.
Line 65, change "round" to -- around --.

Signed and Sealed this

Thirtieth Day of October, 2001

*Attest:*

Nicholas P. Godici

NICHOLAS P. GODICI
*Acting Director of the United States Patent and Trademark Office*

*Attesting Officer*